US006344238B1

(12) United States Patent
Schmitt et al.

(10) Patent No.: US 6,344,238 B1
(45) Date of Patent: Feb. 5, 2002

(54) PROCESS FOR THE PRODUCTION OF FUSIBLE INTERLINING FABRICS

(75) Inventors: Erich Schmitt, Weinheim; Peter Grynaeus, Birkenau; Thomas Kümpel, Hemsbach, all of (DE)

(73) Assignee: Firma Carl Freudenberg, Weinheim (DE)

( * ) Notice: Subject to any disclaimer, the term of this patent is extended or adjusted under 35 U.S.C. 154(b) by 0 days.

(21) Appl. No.: 09/548,470

(22) Filed: Apr. 13, 2000

(30) Foreign Application Priority Data

Apr. 13, 1999 (DE) ..... 199 16 628

(51) Int. Cl.[7] ..... B05D 1/36; B05D 3/12; B32B 5/16

(52) U.S. Cl. ..... 427/202; 427/208.2; 427/261; 427/288; 427/369; 428/206

(58) Field of Search ..... 427/202, 208.2, 427/261, 264, 265, 288, 466, 470, 369; 428/206

(56) References Cited

U.S. PATENT DOCUMENTS 5,569,348 A * 10/1996 Hefele
5,820,928 A * 10/1998 Groshens

FOREIGN PATENT DOCUMENTS

DE 2 214 236 10/1973
JP 7-11585 * 1/1995

* cited by examiner

*Primary Examiner*—Fred J. Parker
(74) *Attorney, Agent, or Firm*—Kenyon & Kenyon

(57) ABSTRACT

A process for the production of fusible interlining fabrics, wherein an interlining fabric (1) is discontinuously printed over its area with a reactive adhesive (2), and a particulate hot-melt glue (3) is applied to the adhesive (2) while it is still reactive. In another step, particles (3.1) can be pressed on, and subsequently the excess particles (3.2) of the hot-melt glue (3) can be removed.

15 Claims, 2 Drawing Sheets

PROCESS FOR THE PRODUCTION OF FUSIBLE INTERLINING FABRICS

FIELD OF THE INVENTION

The invention relates to a process for the production of fusible interlining fabrics, as well as the fusible interlining fabrics that are produced using it. In particular, the invention relates to fusible interlining fabrics for use in outerwear.

DESCRIPTION OF RELATED ART

The demand of interlining processors for a fusible interlining fabric that absolutely does not bleed through on the front or the back has led to various innovations in process technology. For example, dots of adhesive have to be produced that are structured in layers, i.e. composed of a base layer that prevents bleed-through on the back and a cover layer that brings about the adhesive bond with the outer fabric and prevents bleed-through on the front. To achieve an adhesive dot structured in a double layer, various processes are possible, for example the double powder dot process or the double plastic dot process.

Interlining fabrics with a double dot coating are already known (see German Patent 2 214 236). In this connection, the work is performed using the principle of rotary film printing with two interior doctor blades that press the pastes, which have a different adhesive composition, through the same template holes, one directly after the other, so that a paste dot with a layered structure is formed.

It is disadvantageous, however, that in the case of a conventional double dot, the paste (dispersion melt glue) is applied as the bottom dot, and water has to be evaporated. Medium sintering temperatures are required; nevertheless, there is a risk of bleed-through on the back when the interlining fabric has a low base weight.

Furthermore, a double dot with a crosslinking acrylate bottom dot (binder dispersion, for example based on acrylate) requires high temperatures for crosslinking the acrylate and for sintering the applied polymer powder to attach it to the bottom dot.

SUMMARY OF THE INVENTION

It is therefore an object of the invention to provide a process for the production of fusible interlining fabrics that overcomes the disadvantages of the prior art. It is a further object of the invention to provide a process which is suitable for sensitive interlining fabrics and which is economical and simple in its implementation. It is a further object of the invention to provide a process wherein the resultant interlining fabric may be rolled up without having it stick together and wherein the interlining fabric has an unlimited shelf life.

These and other objects of the present invention are accomplished by a process for the production of a fusible interlining fabric wherein a fusible interlining fabric is discontinuously imprinted over its area with a reactive adhesive, and a powdered hot-melt glue is applied to the adhesive while it is still reactive.

When the bottom dots are made of a reactive adhesive, low application temperatures can be used. Therefore there is only slight thermal stress on the substrate.

The invention also includes interlining fabrics produced according to this process.

BRIEF DESCRIPTION OF THE DRAWINGS

The invention will be described in further detail below, using the accompanying drawings in which.

DETAILED DESCRIPTION OF THE INVENTION

In the process according to the present invention, first a reactive adhesive, such as a polyurethane (PU) that crosslinks in the moist state, is applied to temperature-sensitive interlining fabrics using a known hot-melt process, in dots, for example using rototherm/melt printing or screen printing, or discontinuously and irregularly over a large area, for example comparable to the porous coat application method.

Particles of a washable/dryable hot-melt glue are applied to these regions that are provided with the reactive adhesive. They combine with the adhesive, which is still sticky, in the affected areas, and the adhesive binds these particles directly to the interlining fabric.

In accordance with an advantageous further development, bonding of the particles to the adhesive is improved by pressing the particles into the adhesive, which has not yet finished reacting and/or has not yet solidified. Preferably, the excess polymer powder is then removed from the surface of the interlining fabric by means of suitable measures, such as shaking them off, vacuuming them off, etc.

An application of steam can follow to accelerate the process.

Because of the fact that the area that is coated with the reactive adhesive is completely covered with the powder particles of the hot-melt glue, which is not reactive with regard to the interlining fabric, and is not sticky, the layers do not stick together when the fabric is rolled up. During storage, the adhesive can finish reacting and further strengthen the bond with the particles.

An interlining fabric coated in such a way has an unlimited shelf life and can be thermally fused to the appropriate outer fabrics at any time.

Any desired hot-melts can be used as the adhesive. Examples are a hot-melt that crosslinks in the moist state, particularly a polyurethane that crosslinks in the moist state.

The particles of the thermoplastic hot-melt glue are applied immediately after the adhesive is applied. In this connection, it is important that the adhesive has not yet finished reacting, in other words it is still sticky.

The hot-melt glue used is a thermoplastic fixing powder and is not subject to any special restrictions. It is advantageous if the material of the hot-melt glue is made of co-polyester (co-PES), co-polyamide (co-PA), ethylene vinyl acetate (EVA), thermoplastic polyurethane (TPU), or polyethylene (PE). The selection is made as a function of the end use, for example as a function of the outer fabric or the required resistance of the textile to washing/drying.

Any desired interlining fabrics can be treated by the process according to the present invention. Examples for this are nonwoven fabrics, knitted fabrics, or woven fabrics. The interlining fabric can be made of the fibers usually used for interlining fabrics. Examples are interlining fabrics made of polyester (PES), polyamide 6 (PA6), or polyamide 66 (PA66), viscose, cotton, acrylic, and mixtures of them.

Figure 1:
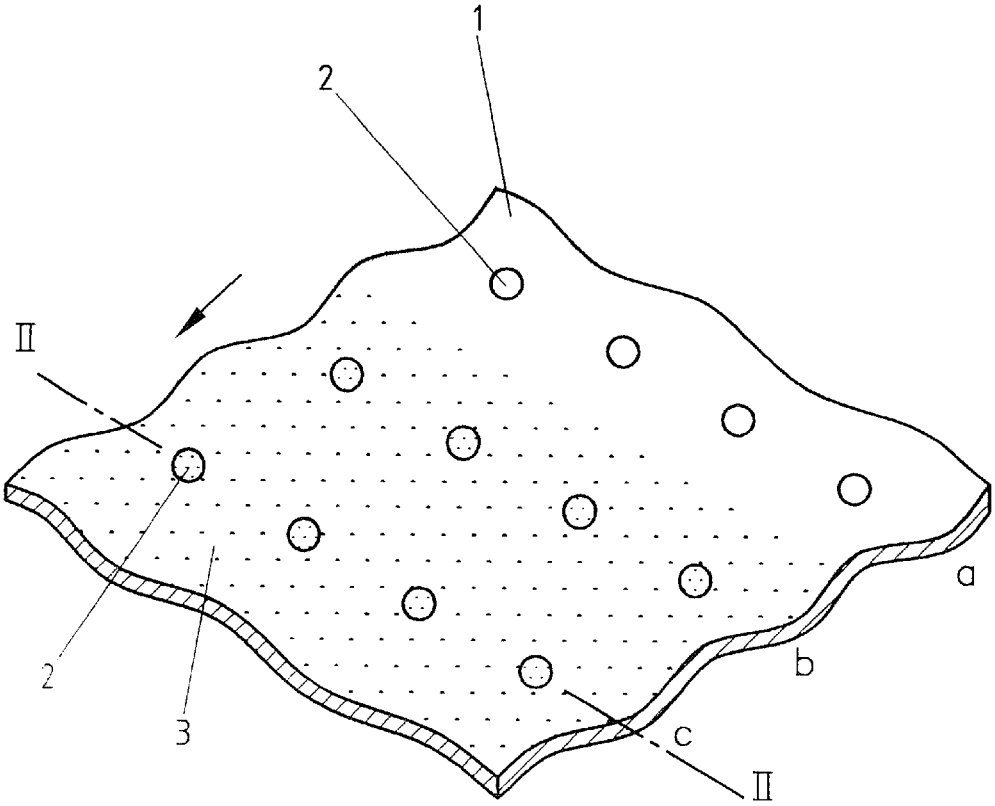
FIG. 1 shows a schematic top view of an interlining fabric provided with reactive adhesive and hot-melt glue.

Interlining fabric 1, shown in FIG. 1, is coated with a reactive adhesive in the form of dots 2 of adhesive. In the exemplary embodiment, these adhesive dots 2 are arranged next to one another in several rows a, b, c.

With the exception of the adhesive dots arranged in row a, adhesive dots 2 are bonded to particles 3 of a hot-melt glue, which were sprinkled onto interlining fabric 1. For this purpose, two principles can be used, namely application with or against gravity, by sprinkling or blowing the particles on.

By moving interlining fabric 1 appropriately, particles 3 are themselves put into motion on interlining fabric 1, so that they reach adhesive dots 2 and bond to them. In this connection, bonding takes place due to the material properties of adhesive dots 2, particles 3 are not reactive relative to interlining fabric 1 in this state, and are not sticky.

Figure 2:
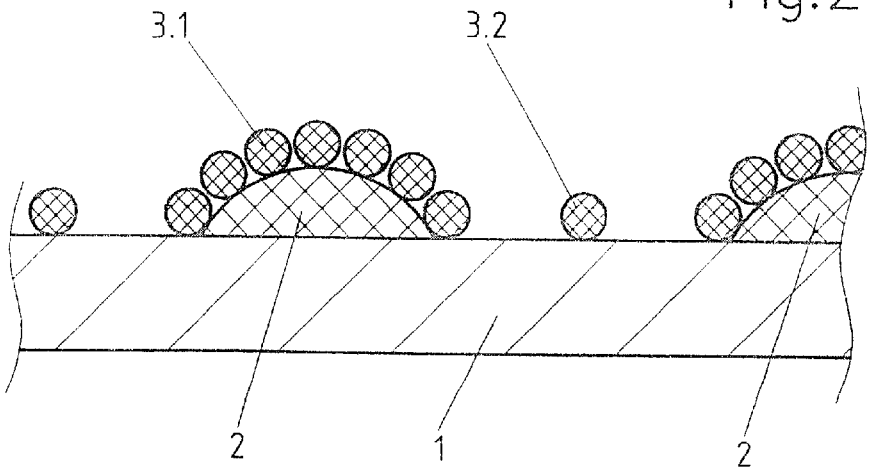
FIG. 2 shows a schematic cross-sectional view through an interlining fabric provided with the reactive adhesive and the hot-melt glue.

FIG. 2 shows a cross-sectional view through row c of FIG. 1. Interlining fabric 1 with adhesive dots 2 located on it and particles 3 of the hot-melt glue can be seen. Particles 3 are bonded to adhesive dots 2 (3.1), for one thing, but also lie loosely on interlining fabric 1 (3.2). Particles 3.2 that lie loosely on the fabric can be easily removed from interlining fabric 1 once adhesive dots 2 have been completely covered.

Figure 2A:
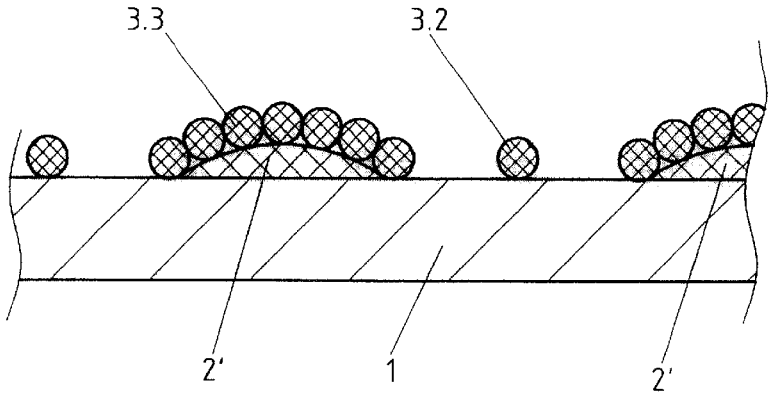
FIG. 2*a* shows a schematic cross-sectional view through the interlining fabric according to FIG. 2 after it has been passed through a roller nip.

FIG. 2*a* shows the aggregate of adhesive dot 2 and particles 3 after they have passed through a roller nip. The roller nip results in a reduction of the height to 0.95 to 0.5 of the original height. This happens, for one thing, in that particles 3.2 are pressed into adhesive dot 2, which has not yet hardened, i.e. solidified, and, for another thing, in that particles 3.3 were deformed. In order to achieve this, it is necessary that an appropriate pressure is exerted using the roller nip.

From the schematic representations, it is easily evident that if adhesive dots 2 are completely covered with particles 3.1 of the hot-melt glue, it is possible to place different interlining fabric on top of one another without having them stick together. In this connection, it is a prerequisite that particles 3 of the hot-melt glue are not reactive relative to interlining fabric 1, and not sticky.

Figure 3:
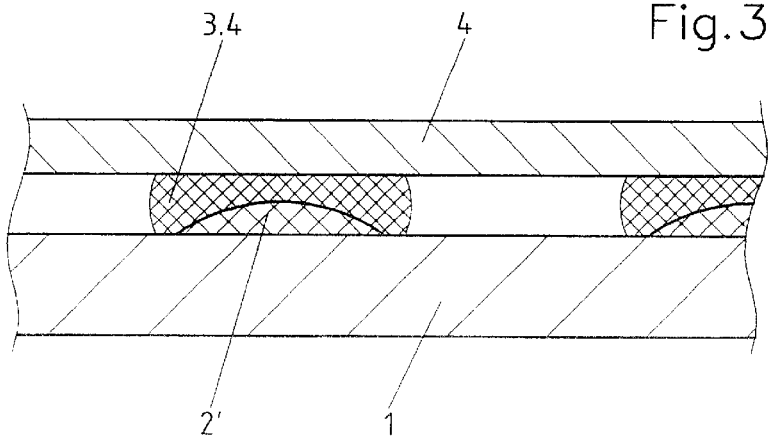
FIG. 3 shows a schematic cross-sectional view through a laminate made up of an interlining fabric and a material web.

FIG. 3 shows a laminate 5 made up of interlining fabric 1 and a material web 4. Laminate 5 was obtained in that interlining fabric 1 shown in FIGS. 1 and 2 was bonded to material web 4, adding heat and pressure, causing particles 3 of the hot-melt glue to melt and form a melt zone 3.4. Adhesive dots 2, made of reactive adhesive, remain essentially unchanged in shape, in contrast to the particles of the hot-melt glue.

Possible reactive adhesives are reactive hot-melt systems that can be applied to sensitive interlining fabrics at relatively low melt temperatures. By bonding them to the particles of a hot-melt glue, particularly thermoplastic polymers, a bond with a material web is possible under the effect of pressure and/or temperature.

Both the application of the powdered hot-melt glue and the removal of excess hot-melt glue can take place with or against gravity, by sprinkling it on and shaking it off, on the one hand, or blowing it on and vacuuming it off, on the other hand. For example, application by blowing the particles on counter to the direction of gravity, onto an interlining fabric that is passed through overhead, allows the excess particles to drop off, while application in the direction of gravity, by sprinkling, allows migration of the particles back and forth, by shaking, before the excess particles are removed by suction.

Figure 4:
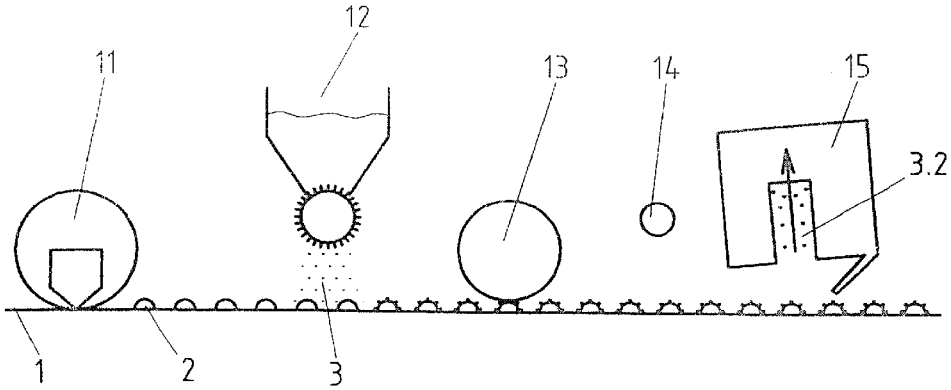
FIG. 4 shows a process sequence for the production of an interlining fabric from FIGS. 1 and 2.

FIG. 4 shows a device for implementing the process according to the present invention. Using an embossing roller 11, polyurethane that crosslinks in the moist state is applied to an interlining fabric 1 in the form of adhesive dots 2. In a next step, particles 3 of a polymer powder as a hot-melt glue are sprinkled onto interlining fabric 1, with adhesive dots 2 applied to it, in the direction of gravity, using a sprinkling device 12. Using a roller 13, particles 3 are intimately bonded to adhesive dots 2, using mechanical pressure.

In order to accelerate the reaction of the polyurethane that crosslinks in the moist state, a steam application device 14 for steam can be provided, if the type of interlining fabric permits this.

Using a suction device 15, excess particles 3.2 of the hot-melt glue are removed from interlining fabric 1, so that only adhesive dots 2 with particles 3.1 that adhere to them remain on interlining fabric 1.

The end product is an interlining fabric with a fully reacted adhesive dot with a thermoplastic coating.

The invention will be explained in greater detail below, using the following examples.

EXAMPLE 1

A nonwoven fabric with a weight of 35 mg/m$^2$ (100% PA6 fibers, thermally bonded using a dot calander) is imprinted with 3 g/m$^2$ of a PU that crosslinks in the moist state (procured from Ceca, a subsidiary of Atofina), using the screen printing process, with a CP 52 stencil (52 dots/cm$^2$), at 80° C. Immediately afterward, during the open time of the reactive hot-melt, 14 g/m$^2$ of a thermoplastic polyester powder (Griltex 9), with a grain fraction of 80–160 $\mu$, are sprinkled over the surface area. The polymer particles that were sprinkled on adhere to the sticky hot-melt dots (if necessary, bonding is supported by slight pressure); excess powder particles are removed by suction, so that a total of 7 g/m$^2$ of the polymer powder remains bonded to the reactive mass. The coated interlining fabric is rolled up. This interlining fabric, with hot-melt glue applied to it in this way, can be laminated to suitable outer fabrics at 140° C., using a continuous press.

EXAMPLE 2

A nonwoven fabric with a weight of 25 mg/m$^2$ (85% PES/15% PA6 fibers, thermally bonded using a dot calander) is imprinted with 4 g/m$^2$ of a PU that crosslinks in the moist state (procured from H. B. Fuller), using the rototherm process, using a CP 37 embossing roller (37 dots/cm$^2$), at 95° C. Immediately afterward, during the open time of the reactive hot-melt, 24 g/m$^2$ of a thermoplastic polyamide powder (Platamid H106 from Atochem), with a grain fraction of 0–160 $\mu$, are applied by blowing them through a powder gun (Nordson system). The polymer particles that were applied adhere to the sticky hot-melt dots (if necessary, bonding is supported by slight pressure); excess powder particles are removed by shaking them off, so that a total of 8 g/m$^2$ of the polymer powder remains bonded to the reactive mass. To accelerate crosslinking, the goods are steamed. The coated interlining fabric is rolled up. This interlining fabric, with hot-melt glue applied to it in this way, can be laminated to suitable outer fabrics at 130° C., using a web calander.

What is claimed is:

1. A process for producing a fusible interlining fabric (1), comprising the steps of:

discontinuously imprinting an area of an interlining fabric (1) with a reactive adhesive (2);

applying a powdered hot-melt glue (3) to the adhesive (2) while the adhesive is still reactive; and directly pressing the hot-melt glue (3) into the adhesive (2), at a time when the adhesive (2) has not yet finished reacting or has not yet solidified.

2. The process according to claim 1, further comprising the step of removing excess particles (3.2) of the hot-melt glue (3).

3. The process according to claim 1, wherein the adhesive (2) crosslinks in a moist state.

4. The process according to claim 3, wherein the adhesive (2) is a polyurethane that crosslinks in a moist state.

5. The process according to claim 1, wherein the hot-melt glue (3) is selected from the group consisting of co-polyester, co-polyamide, ethylene vinyl acetate, thermoplastic polyurethane, and polyethylene.

6. The process according to claim 3, wherein the hot-melt glue (3) is selected from the group consisting of co-polyester, co-polyamide, ethylene vinyl acetate, thermoplastic polyurethane, and polyethylene.

7. The process according to claim 4, wherein the hot-melt glue (3) is selected from the group consisting of co-polyester, co-polyamide, ethylene vinyl acetate, thermoplastic polyurethane, and polyethylene.

8. The process according to claim 1, wherein the interlining fabric (1) is a nonwoven fabric, a knitted fabric, or a woven fabric.

9. The process according to claim 3, wherein the interlining fabric (1) is a nonwoven fabric, a knitted fabric, or a woven fabric.

10. The process according to claim 5, wherein the interlining fabric (1) is a nonwoven fabric, a knitted fabric, or a woven fabric.

11. The process according to claim 1, wherein the interlining fabric (1) is composed of a material selected from the group consisting of polyester, polyamide 6, polyamide 66, viscose, cotton, and acrylic, and mixtures thereof.

12. The process according to claim 3, wherein the interlining fabric (1) is composed of a material selected from the group consisting of polyester, polyamide 6, polyamide 66, viscose, cotton, and acrylic, and mixtures thereof.

13. The process according to claim 1, wherein steam is applied to the interlining fabric immediately following the pressing step.

14. A fusible interlining fabric, produced according to the process of claim 1.

15. An outerwear garment containing the interlining fabric according to claim 14.

* * * * *